US007347340B2

(12) United States Patent
Carola

(10) Patent No.: US 7,347,340 B2
(45) Date of Patent: Mar. 25, 2008

(54) FOLDING CONTAINER

(75) Inventor: Andrea Carola, London (GB)

(73) Assignee: Consumer and Industrial Property Development Limited, London (GB)

( * ) Notice: Subject to any disclaimer, the term of this patent is extended or adjusted under 35 U.S.C. 154(b) by 330 days.

(21) Appl. No.: 10/887,379

(22) Filed: Jul. 8, 2004

(65) Prior Publication Data

US 2006/0006175 A1 Jan. 12, 2006

(51) Int. Cl.
*B65D 8/18* (2006.01)
*B65D 6/00* (2006.01)
*B65D 8/14* (2006.01)

(52) U.S. Cl. ..... 220/6; 220/666; 220/4.28

(58) Field of Classification Search ..... 220/6, 220/666, 4.28, 4.29, 7; 217/12 R, 13, 15, 217/43 R, 45, 47
See application file for complete search history.

(56) References Cited

U.S. PATENT DOCUMENTS 3,499,398 A * 3/1970 Murray ..... 108/53.5
3,765,556 A * 10/1973 Baer ..... 220/1.5
3,941,271 A 3/1976 Zarges et al.
5,056,667 A * 10/1991 Coogan ..... 206/600
5,642,830 A 7/1997 Foster
6,401,953 B2 * 6/2002 Kofod ..... 220/7
2003/0127456 A1 * 7/2003 Brown ..... 220/4.33

FOREIGN PATENT DOCUMENTS

DE 11 44 178 2/1963
DE 21 39 147 2/1973
EP 1 028 061 8/2000
GB 2214903 A * 9/1989

* cited by examiner

*Primary Examiner*—Anthony D. Stashick
*Assistant Examiner*—Shawn M. Braden
(74) *Attorney, Agent, or Firm*—Seyfarth Shaw LLP

(57) ABSTRACT

A folding container has a base, side support tubes upstanding from the corners of the base, and side panels located between the side support tubes and arranged to bound a storage space. Pivots are arranged to pivotally mount the side panels onto the side support tubes. The pivot for each side panel is disposed in a different horizontal plane to that of any other panel, such that when the container is in a folded state the side panels lie stacked substantially parallel to the base, and when in an unfolded state the side panels are substantially orthogonal to the base.

10 Claims, 13 Drawing Sheets

FOLDING CONTAINER

BACKGROUND OF THE INVENTION

1) Field of the Invention

This invention relates to a folding container and in particular to but not exclusively to a packing case, a shipping crate or a freight container.

2) Description of the Related Art

Containers are required for a variety of purposes and, in many circumstances, such as moving automotive parts or possessions between houses or flats and in the case of mobile offices, it is necessary for the container to be sufficiently sturdy to protect the container contents from damage when it is moved or accidentally knocked. However, such a container is unlikely to be in constant use, and as a result it would be advantageous if it could be stored in a flat condition when it is not required.

Containers having opposing side walls which fold onto a base panel have been described in DE 1 144 178 and DE 2 139 147.

U.S. Pat. No. 3,941,271 relates to a collapsible receptacle having inwardly and outwardly directed projections on a base panel frame and sidewalls. The outwardly directed projection of the sidewall overlaps the inwardly directed projection of the base panel frame to maintain the receptacle in the assembled non-collapsed condition such that a tilting of the sidewalls is necessary to raise the sidewall.

U.S. Pat. No. 5,642,830 describes a container having top and bottom members, and columnar members which are received in the top and bottom members when the container is in the assembled condition. When the container is disassembled the columnar members and side members may be stored inside the top and bottom members which are jointed together so that the disassembled container forms an integral unit.

A collapsible container is described in EP 1 028 061 having side panels associated with a base panel and movable between a collapsed and an assembled condition. The container is releasably retained in the assembled condition by side supports engaging adjacent side panels, the side supports comprising upright members demountably secured to the base panel and received and retained by a receptacle secured at or adjacent to the corners of the base panel.

There remains, however, a need for a compact, economical folding container design which can be readily converted from a folded to an unfolded state and which is adaptable for industrial use e.g. in shipping and intermodal containers.

SUMMARY OF THE INVENTION

A preferred feature of the present invention is directed to a folding container comprising a base panel, side support means upstanding from the corners of the base panel, side panels located between the side support means and arranged to bound a storage space, and pivot means arranged to pivotally mount the side panels onto the side support means, wherein the pivot means for each side panel is disposed in a different horizontal plane to that of any other panel, such that when the container is in a folded state the side panels lie stacked substantially parallel to the base panel, and when in an unfolded state the side panels are substantially orthogonal to the base panel.

In a preferred embodiment the side support means includes a two part columnar member comprising a first member adjacent to the base panel and a second member remote from the base panel, the second member being pivotally secured to the first member at a position such that when the container is in the folded state the second member can be folded onto a surface of an upper one of the stacked side panels.

Preferably each side panel is pivotally mounted onto each of two adjacent side support means. More preferably each side panel substantially occupies a space between adjacent support means onto which each side panel is mounted.

Preferably the pivot means of each side panel comprises a male means cooperating with a slot in an edge of the side panel which is adjacent to the side support means when the container is unfolded, wherein said slot is terminated.

The male means may be arranged to be a free sliding fit along the length of a mating slot in each of the panel edges.

Preferably the male means comprises a pair of circularly cross sectioned pins located on adjacent side support means, wherein each pair of pins is arranged to mount side panels each at a different distance from the base panel.

In a preferred embodiment a first pair of pins associated with a first side panel is located at a distance T-S/2 from the base panel, where T is S+R, S is the thickness of a side panel, and R is the distance between adjacent panels, a second pair of pins associated with a second side panel is located at a second distance, which is 2T-S/2 from the base panel, a third pair of pins associated with a third side panel is located at a third distance, which is 3T-S/2 from the base panel, and a fourth pair of pins associated with a fourth side panel is located at a fourth distance, which is 4T-S/2 from the base panel.

Securing means may be provided on the side panels to secure each individual side panel in the unfolded state.

A cover panel may be pivotally mounted onto one of the side panels.

Preferably the side panels are formed from metal or plastic sheet material.

In a particularly preferred embodiment the base panel, side panels and support means form an integral unit.

In another embodiment the invention is directed to a folding container comprising a base panel, side support means upstanding from the corners of the base panel, side panels located between the side support means and arranged to bound a storage space, and pivot means arranged to pivotally mount the side panels onto the side support means, wherein the pivot means for each side panel is disposed in a different horizontal plane to that of any other panel, such that when the container is in a folded state the side panels lie stacked substantially parallel to the base panel, and when in an unfolded state the side panels are substantially orthogonal to the base panel, and the side support means includes a two part columnar member comprising a first member adjacent to the base panel and a second member remote from the base panel, the second member being pivotally secured to the first member at a position such that when the container is in the folded state the second member can be folded onto a surface of an upper one of the stacked side panels.

In a further embodiment the invention provides for a folding container comprising a base panel, side support means upstanding from the corners of the base panel, side panels located between the side support means and arranged to bound a storage space, and pivot means arranged to pivotally mount the side panels onto the side support means, wherein:

the pivot means for each side panel is disposed in a different horizontal plane to that of any other panel, such that when the container is in a folded state the side panels lie stacked substantially parallel to the base panel, and when in an unfolded state the side panels are substantially orthogonal to the base panel, the pivot means of each side panel is provided by a slot in each edge of the side panel which are adjacent to the side support means when the container is unfolded, said slot being terminated, and male means located on the side support means arranged to engage with the slots, the male means comprises a pair of circularly cross sectioned pins located on adjacent side support means, wherein each pair of pins is arranged to mount side panels each at a different distance from the base panel, and a first pair of pins associated with a first side panel is located at a distance T-S/2 from the base panel, where T is S+R, S is the thickness of a side panel, and R is the distance between adjacent panels, a second pair of pins associated with a second side panel is located at a second distance, which is 2T-S/2 from the base panel, a third pair of pins associated with a third side panel is located at a third distance, which is 3T-S/2 from the base panel, and a fourth pair of pins associated with a fourth side panel is located at a fourth distance, which is 4T-S/2 from the base panel.

BRIEF DESCRIPTION OF THE DRAWINGS

The present invention will be further understood by reference to the accompanying drawings showing an exemplary embodiment thereof.

FIG. 17 shows the fully unfolded container with side panels secured.

In the Figures like reference numerals have the like parts.

DESCRIPTION OF THE PREFERRED EMBODIMENTS

Figure 1:
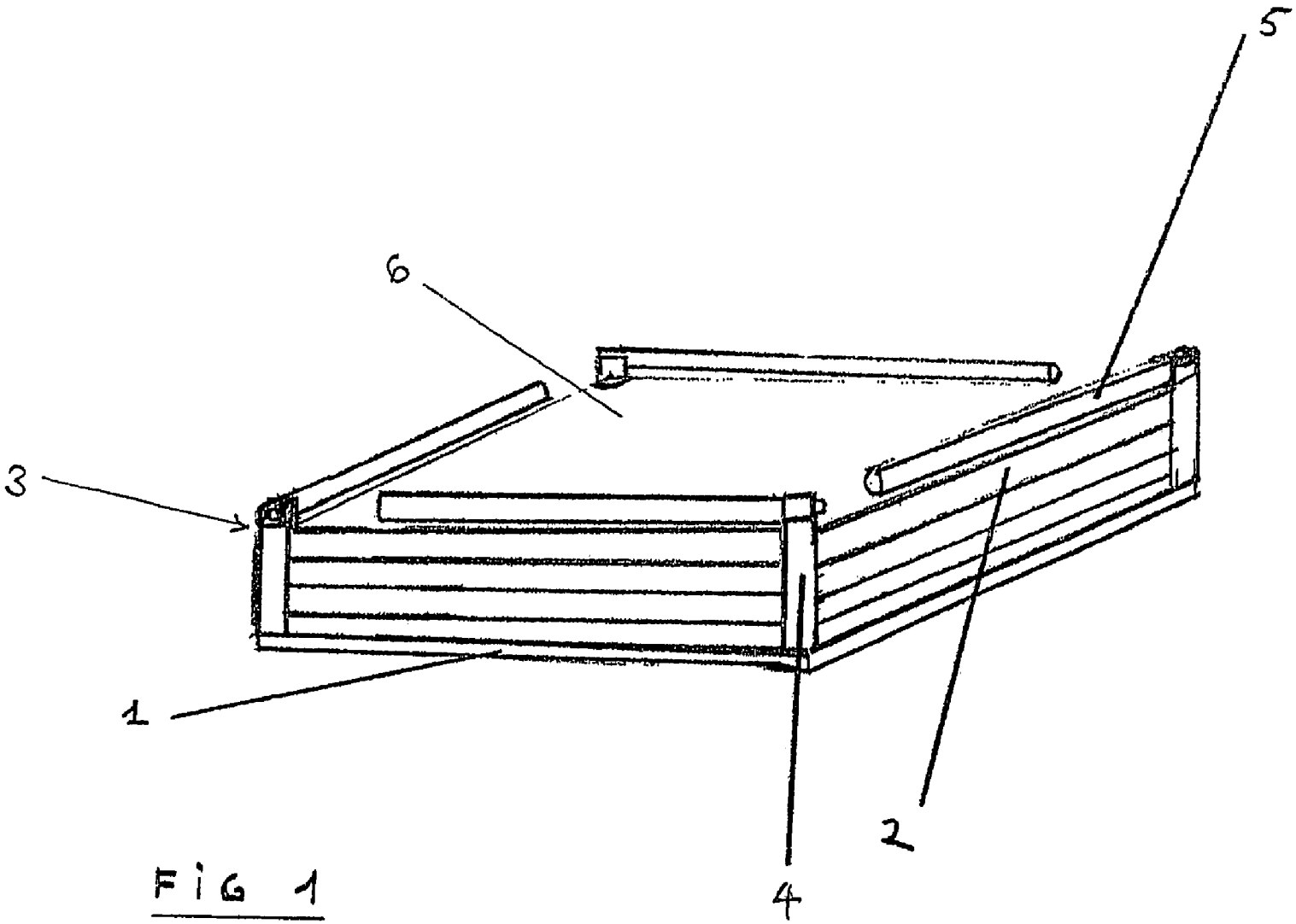
FIG. 1 is a perspective view of a preferred embodiment of a container in accordance with this invention in a folded state.

The folded container illustrated in FIG. 1 has a substantially rectangular base panel 1, four side panels 2 stacked on top of the base panel, and four two-part side support tubes 3 upstanding from the corners of the base panel, each support tube having a lower member 4 adjacent to the base panel and an upper member 5 remote from the base panel. The support tubes 3 have a circular cross section but it will be understood that other suitable cross sections may be used. The upper member 5 is pivotally secured to the lower member 4 and is folded onto the surface 6 of the upper stacked side panel. The base panel 1, side panels 2 and side support tubes 3 are formed from metal sheet material.

Figure 2:
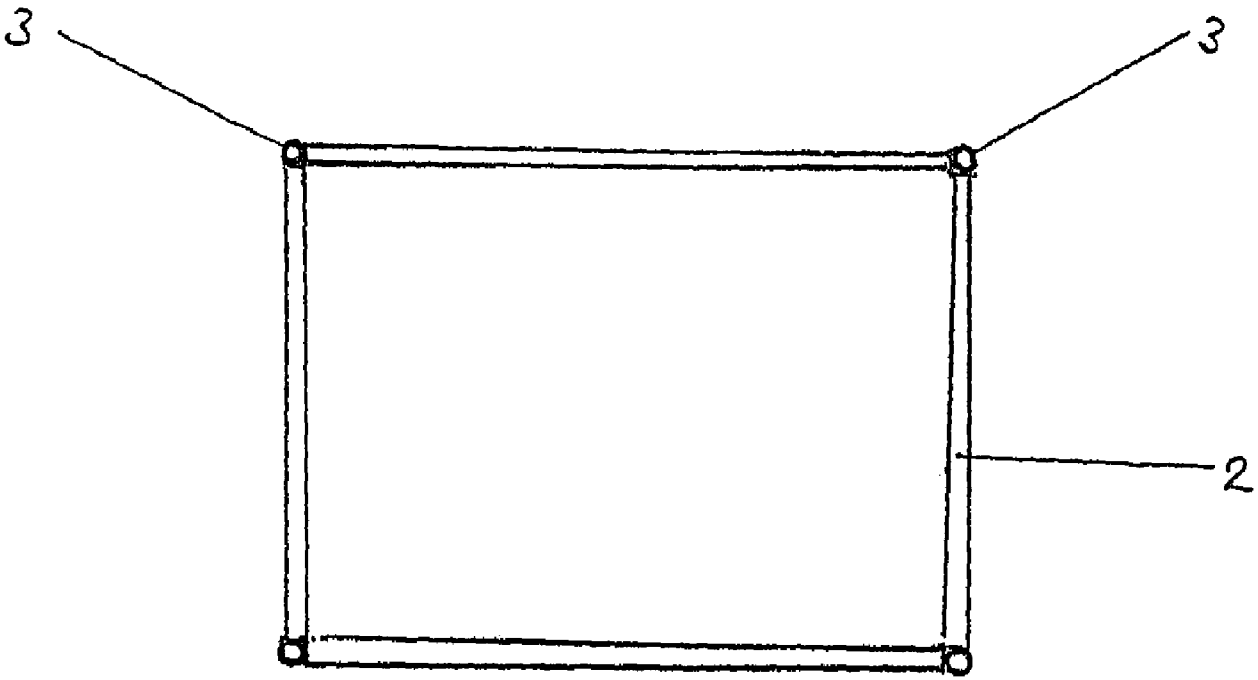
FIG. 2 is a top view of the container in an unfolded state.

Referring to FIG. 2, each of the side panels 2 in the unfolded container occupies the space between two adjacent side support tubes 3 onto which the side panels are pivotally mounted, as will now be described.

Figure 3:
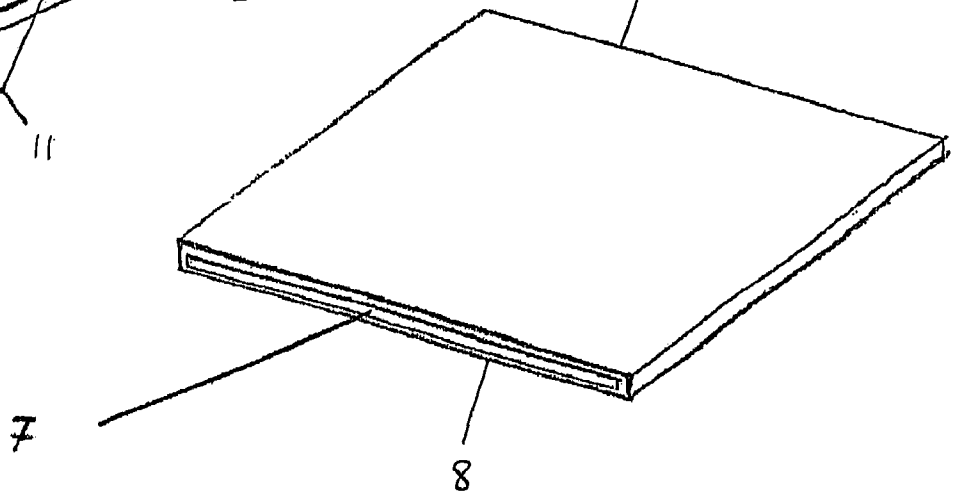
FIG. 3 is a perspective view of a side panel of the container.

FIG. 3 shows a side panel 2 having a terminated longitudinal slot 7 in one edge 8. A similar slot is located in the opposing edge of the side panel.

Figure 4:
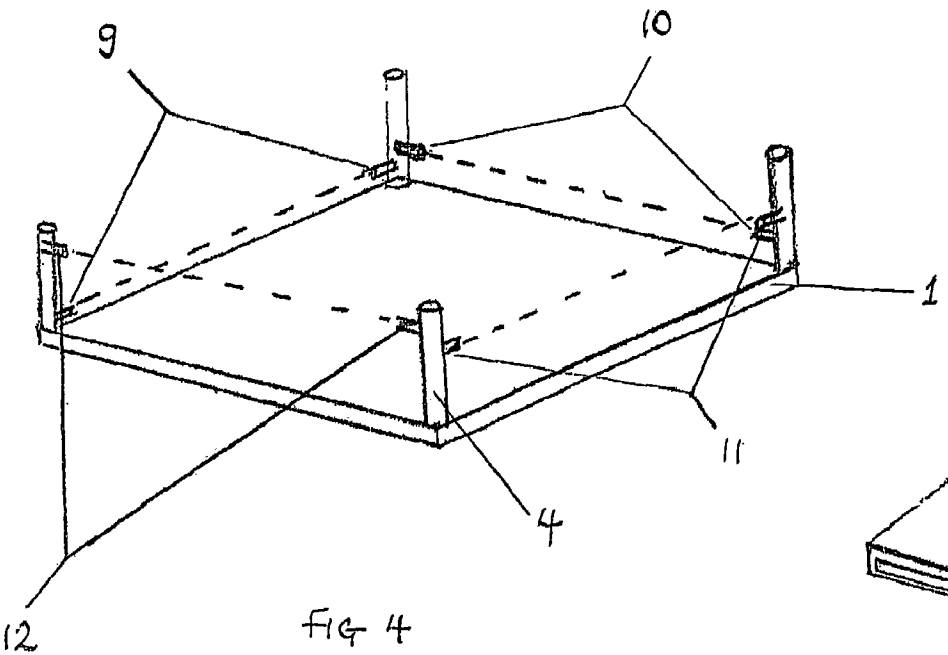
FIG. 4 is a perspective view of a base panel of the container.

Four pairs of laterally projecting cylindrical pins 9, 10, 11 and 12 are located on the lower members 4 of adjacent support tubes as shown in FIG. 4. Each pair of pins is located at a different distance from the base panel with respect to any of the other pairs. Preferably the first pair of pins 9 closest to the base panel are located at a distance T-S/2 from the base panel, where T is S+R, S is the thickness of a side panel, and R is the distance between adjacent side panels, the second pair of pins 10 at a distance 2T-S/2 from the base panel, the third pair of pins 11 at a distance 3T-S/2 from the base panel, and the fourth pair of pins 12 furthest from the base panel are at a distance 4T-S/2 from the base panel.

Figure 11:
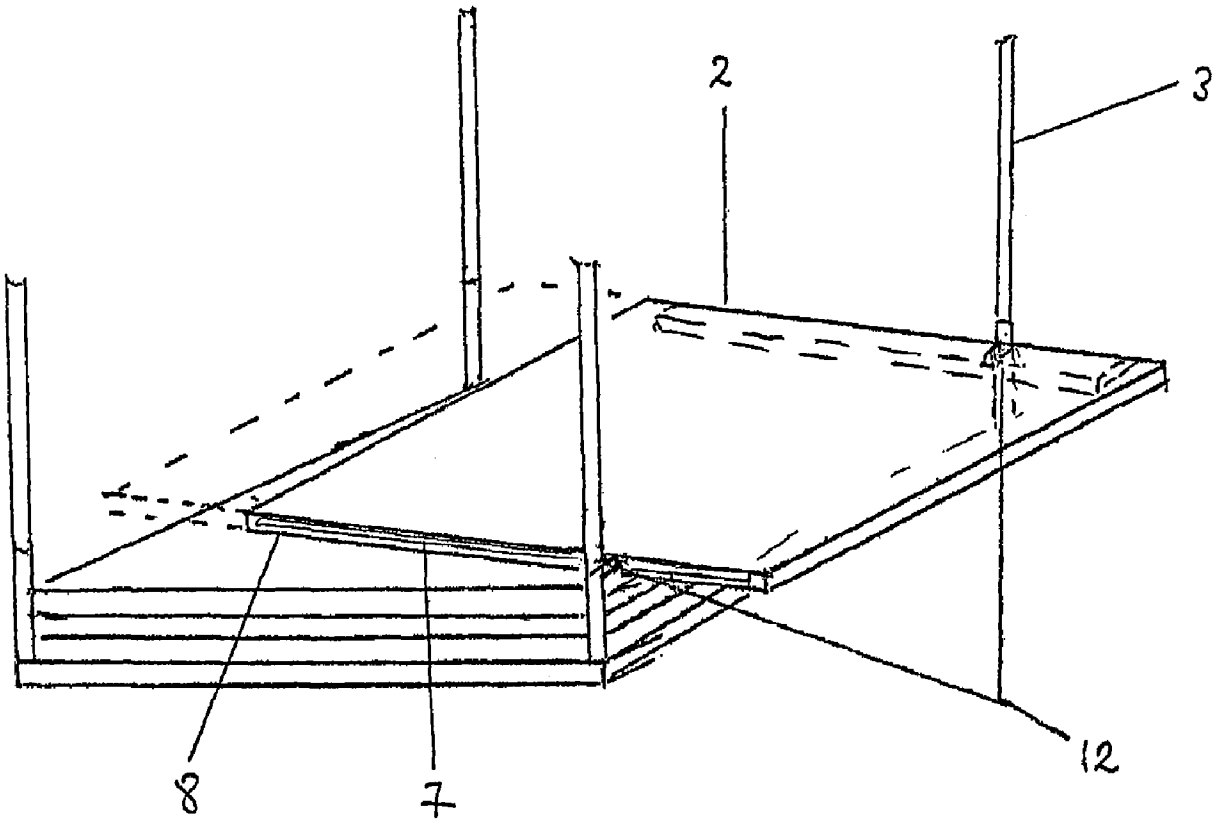

Each side panel 2 is mounted onto adjacent support tubes 3 by engagement of the relevant pair of slots 7 in the side panel edges 8 with a corresponding pair of cylindrical pins 12 as shown in FIG. 11. Each slot 7 is closed at opposing ends to retain the pin 12 associated therewith. The pins 12 engage with the slots 7 in a free sliding fashion so that the side panel 2 can undergo translational movement in the slot plane as well as pivotal movement about the pin axis. The spacing of the pairs of pins 12 from the base panel 1 ensures that in the folded state the side panels 2 stack together in different horizontal planes overlying the base panel 1 as shown in FIG. 1.

Figure 7B:
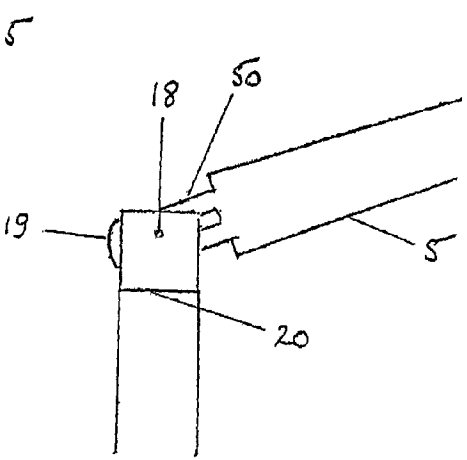
FIGS. 7*a* and 7*b* show side views of the side support means in different operational states thereof.
Figure 7A:
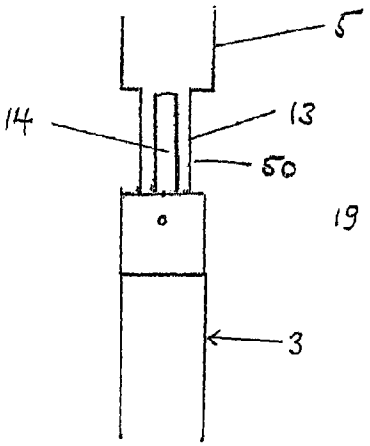
Figure 6:
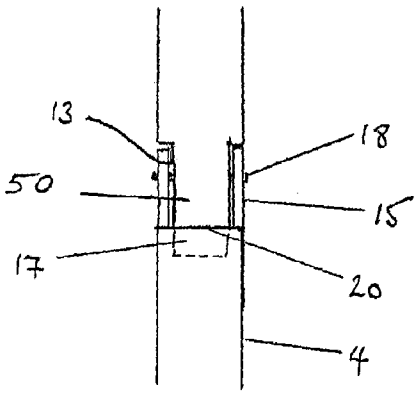
FIGS. 5 and 6 show mutually orthogonal side views of a side support means in an unfolded state.
Figure 5:
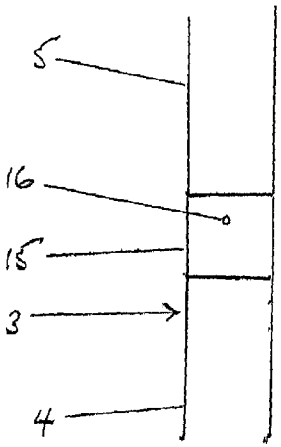
Figure 7:
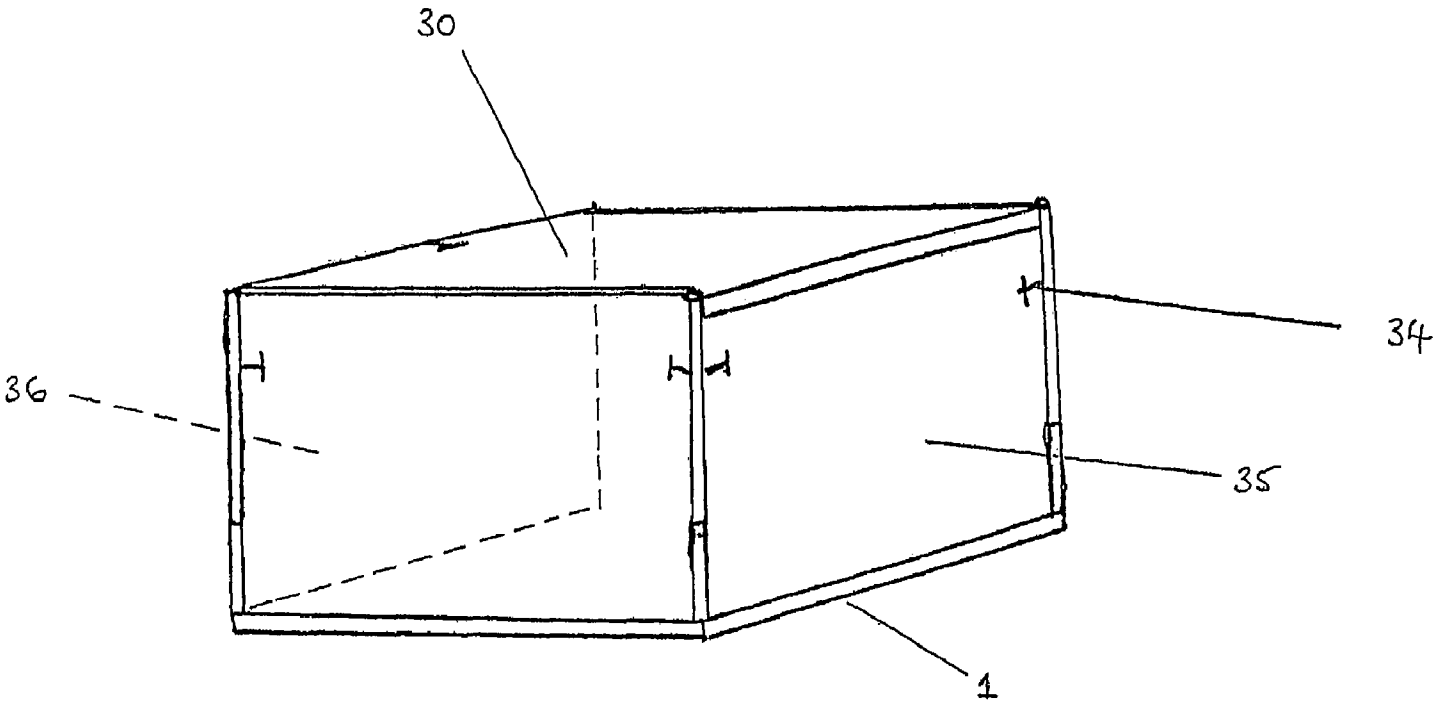

Referring to FIGS. 5 and 7*a*, the upper member 5 of a side support tube 3 has an extension 50 formed by a pair of opposed flat surfaces 13 projecting from its lower end with a longitudinal opening 14 therein. Part of the wall of the lower member 4 of the side support tube 3 projects vertically from its upper end to form two opposing end pieces 15, each end piece having a circular hole 16 located therein as shown in the mutually orthogonal side views of FIGS. 5 and 6. The opposing end pieces 15 define a recess 17, which partially extends into the tubular lower member 4, and which is dimensioned so as to receive the extension 50 of the upper member 5 in close fitting engagement, with the holes 16 aligning with the longitudinal opening 14 of the extension 50. A cylindrically cross sectioned bar 18 projects laterally through opposing holes 16 and opening 14 so as to retain the upper member 5 of the side support within the lower member 4. The bar 18 is in sliding engagement with the extension 50 so that the upper member 5 can be vertically extended with respect to the lower member 4 (FIG. 7*a*).

Referring to FIGS. 7*a* and 7*b* the side support 3 can be moved from a substantially vertical unfolded position to a folded position substantially perpendicular to the lower member 4 by extending the upper member 5 until the lower edge 19 of the extension 50 is clear of the upper edge 20 of the lower member followed by rotation of the upper member 5 about the axis of the bar 18.

Figure 8:
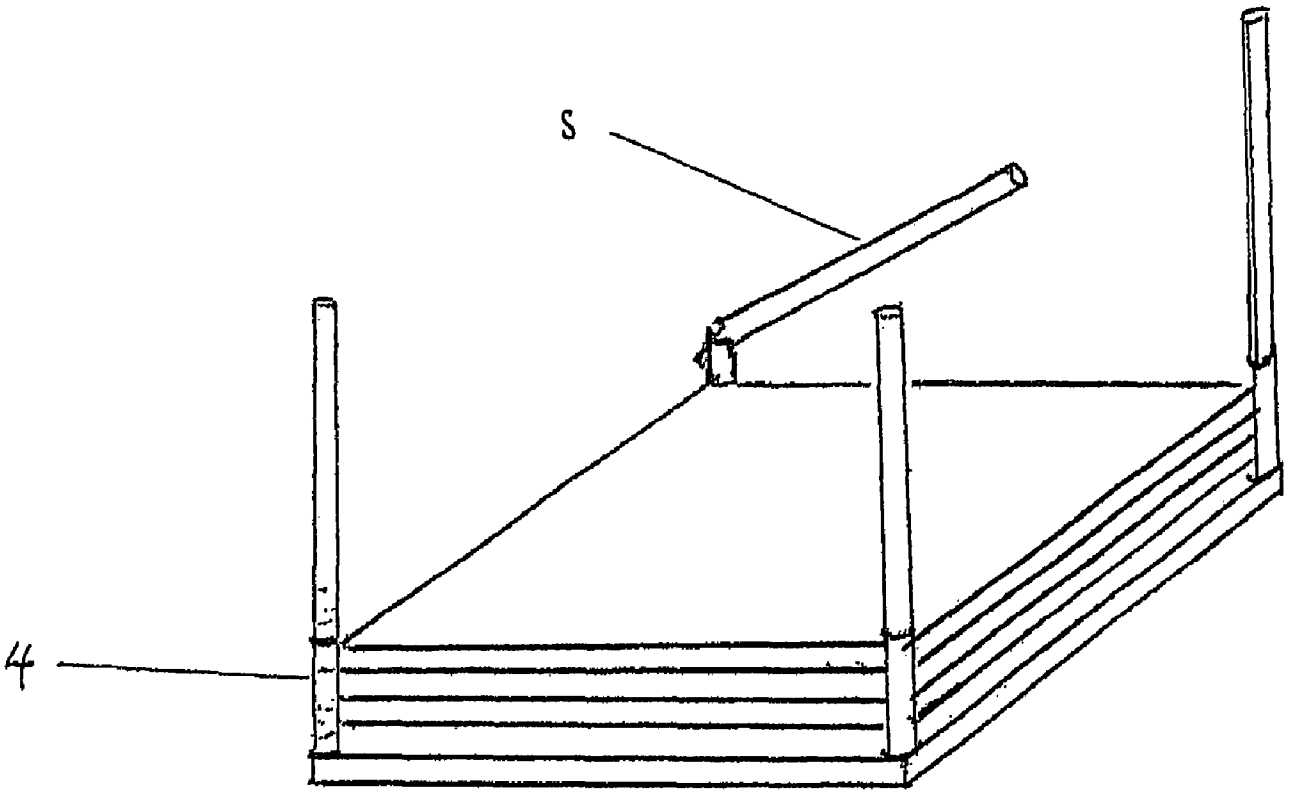
FIG. 8 is a perspective view of the container shown in FIG. 1 with the side support means partially unfolded, FIGS. 9, 10 and FIGS. 11,12 respectively show alternative constructions for moving a side panel from a folded to an unfolded state.

In erecting the container from a collapsed, folded condition, a first step is to rotate the upper members 5 of the four side support tubes 3 in turn from the folded position, where the upper members 5 are lying on the surface 6 of the uppermost side panel 2 as shown in FIG. 1, to the unfolded position where the upper members 5 are substantially vertical and form continuous columns with the corresponding lower members 4 as shown in FIG. 8.

Figure 12:
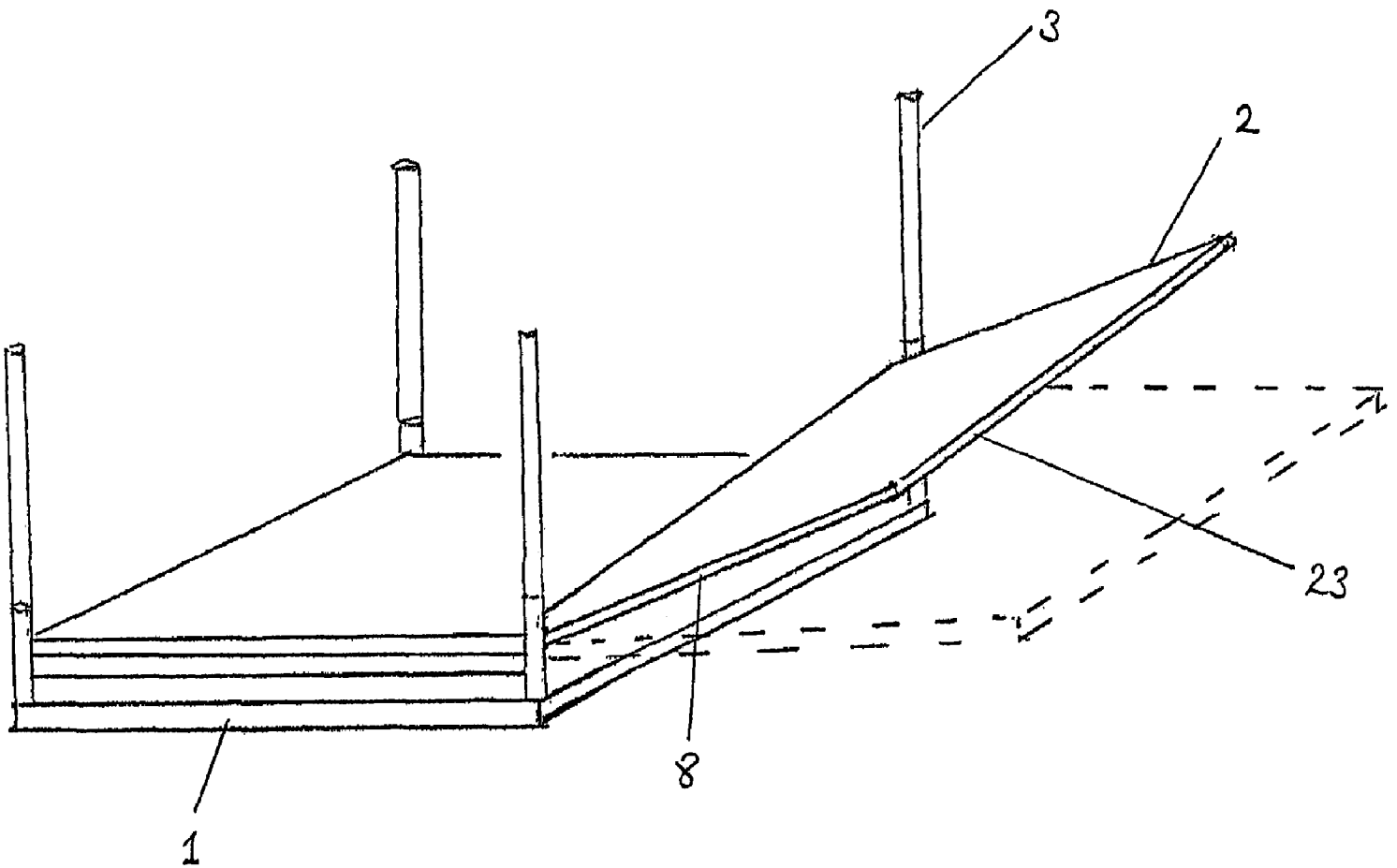

In a second step each side panel 2 of the container is moved in turn from a folded to an unfolded position and preferably fastened to adjacent side support tubes 3 before the next side panel is unfolded. There are two alternative methods for performing this step as shown in FIGS. 9, 10 and in FIGS. 11, 12 respectively.

Figure 9:
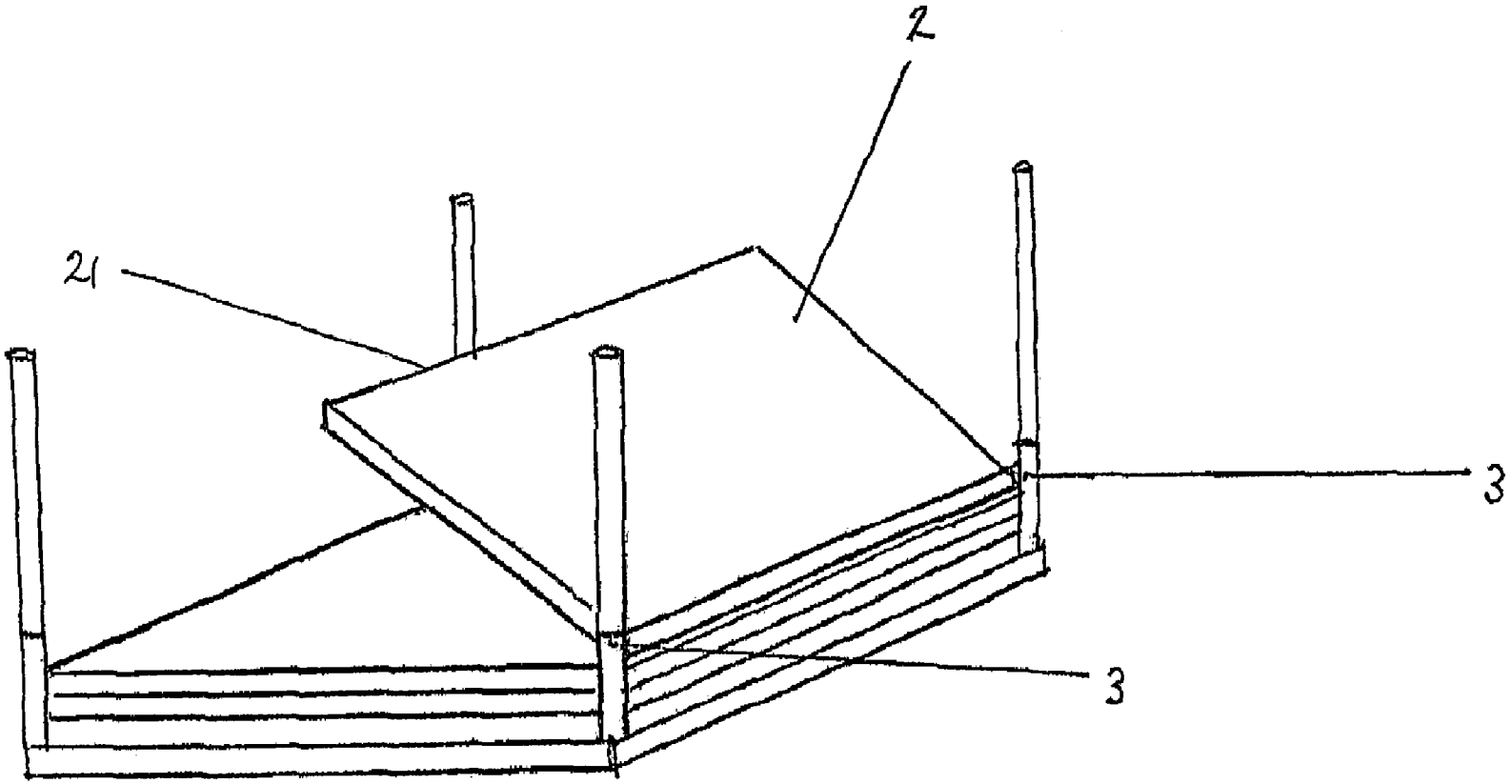
Figure 10:
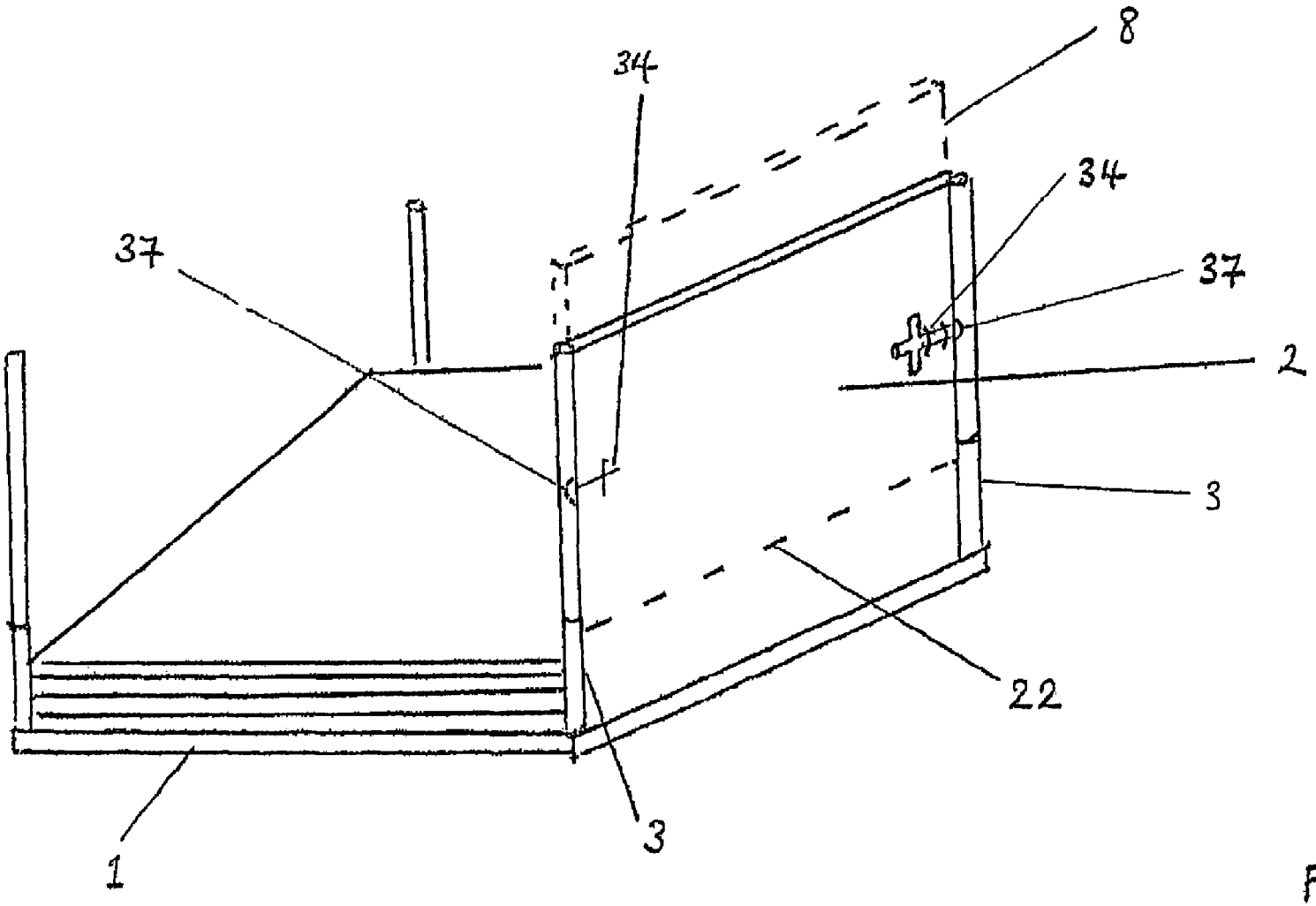

In a first method the edge 21 of the uppermost side panel 2 furthest from the side support tubes 3 onto which it is mounted is raised and rotated upwards towards the side support tubes 3 (shown in FIG. 9). When the side panel 2 is in a substantially vertical position, with the opposing edges 8 parallel to the corresponding side support tubes 3, the side panel 2 is lowered vertically towards the container base panel 1 and into the unfolded position with a bottom edge 22 of the side panel resting on the upper surface of the base panel 1 (shown in FIG. 10). The side panel 2 is then fastened to adjacent side support tubes 3 by sliding engagement of bolts 34 secured to the side panel 2 within corresponding recesses 37 in the side support tubes 3. The process is repeated for the remaining side panels in turn.

In a second method the uppermost side panel 2 is slid in a substantially horizontal plane outwards between the side support tubes 3 onto which it is mounted (shown in FIG. 11). When the side panel 2 has been translated in this plane as far from the side support tubes 3 as the slots 7 in the edges 8 will allow, the edge 23 of the side panel 2 furthest from the side support tubes 3 is raised and rotated upwards towards the side support tubes 3 (shown in FIG. 12). When the side panel 2 is in a substantially vertical position, with the opposing pivoting edges 8 parallel to the corresponding side support tubes 3, the side panel 2 is lowered vertically towards the container base panel 1 and into the unfolded position with the bottom edge of the side panel resting on the upper surface of the base panel 1. The side panel 2 is then fastened to adjacent side support tubes 3 as described in the first method. The process is repeated for the remaining side panels in turn.

Figure 13:
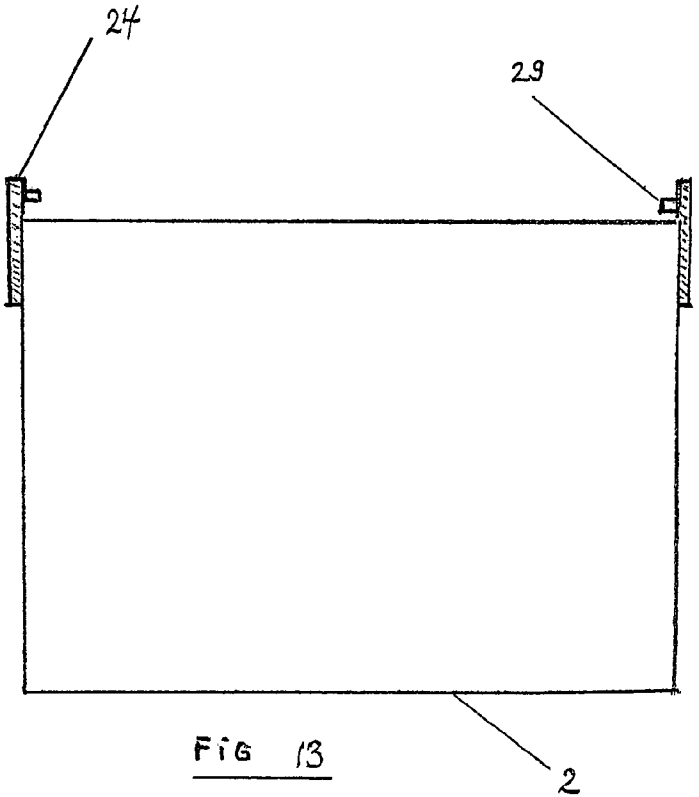
FIGS. 13 shows a side panel onto which a cover panel is to be mounted.
Figure 14B:
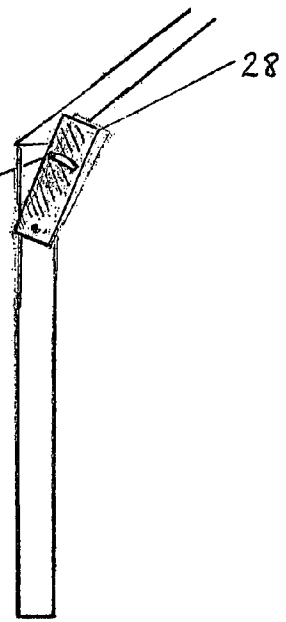
FIGS. 14*a* and 14*b* show a pivoting arm of the side panel of FIG. 13 in different operational states.
Figure 14A:
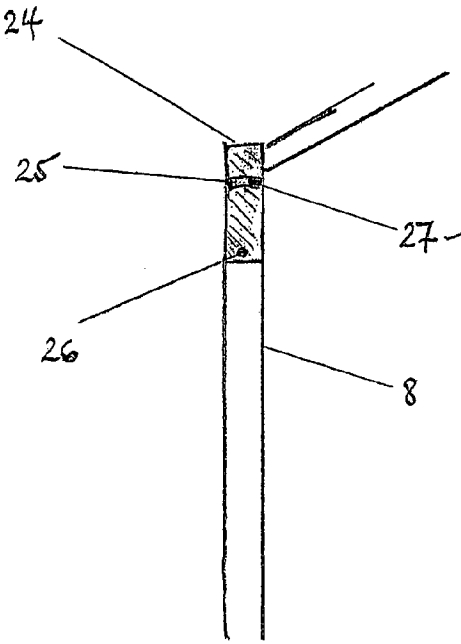
Figure 15:
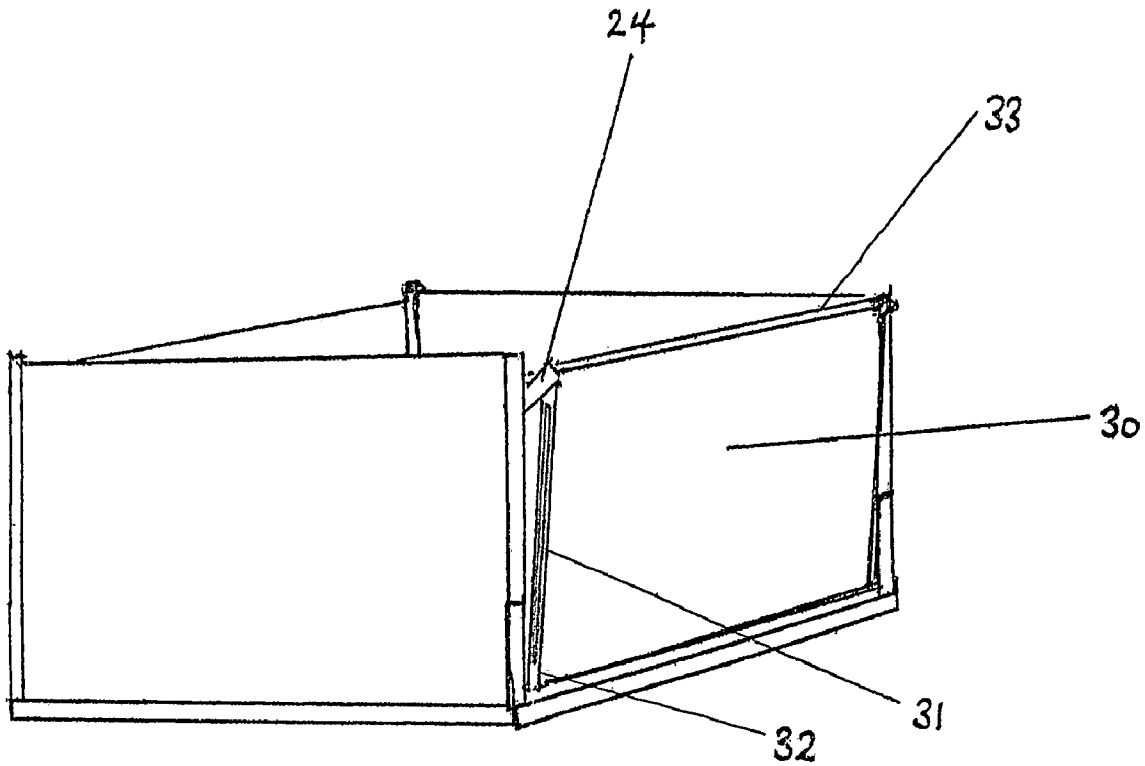
FIGS. 15 and 16 show a cover panel being moved from a folded to an unfolded state.

A cover panel 30 is pivotally mounted onto the side panel 2 that is uppermost when the container is in the folded state by pivoted arms 24 as shown in FIGS. 13-15. Each arm 24 has a pin 29 arranged to co-operate with a slot 31 in opposing edges 32 of the cover panel 30. The arm 24 also has an arcuate slot 25 cooperating with a pin 27 extending laterally through the curved slot 25 and in free sliding engagement therein. The arm 24 is secured to the edge 8 of the side panel 2 by a pin 26 (FIG. 14*a*). The arm 24 can be partially rotated from a vertical position by pivoting about the pin 26 and sliding of the pin 27 through the slot 25 as shown in FIG. 14*b*.

Figure 16:
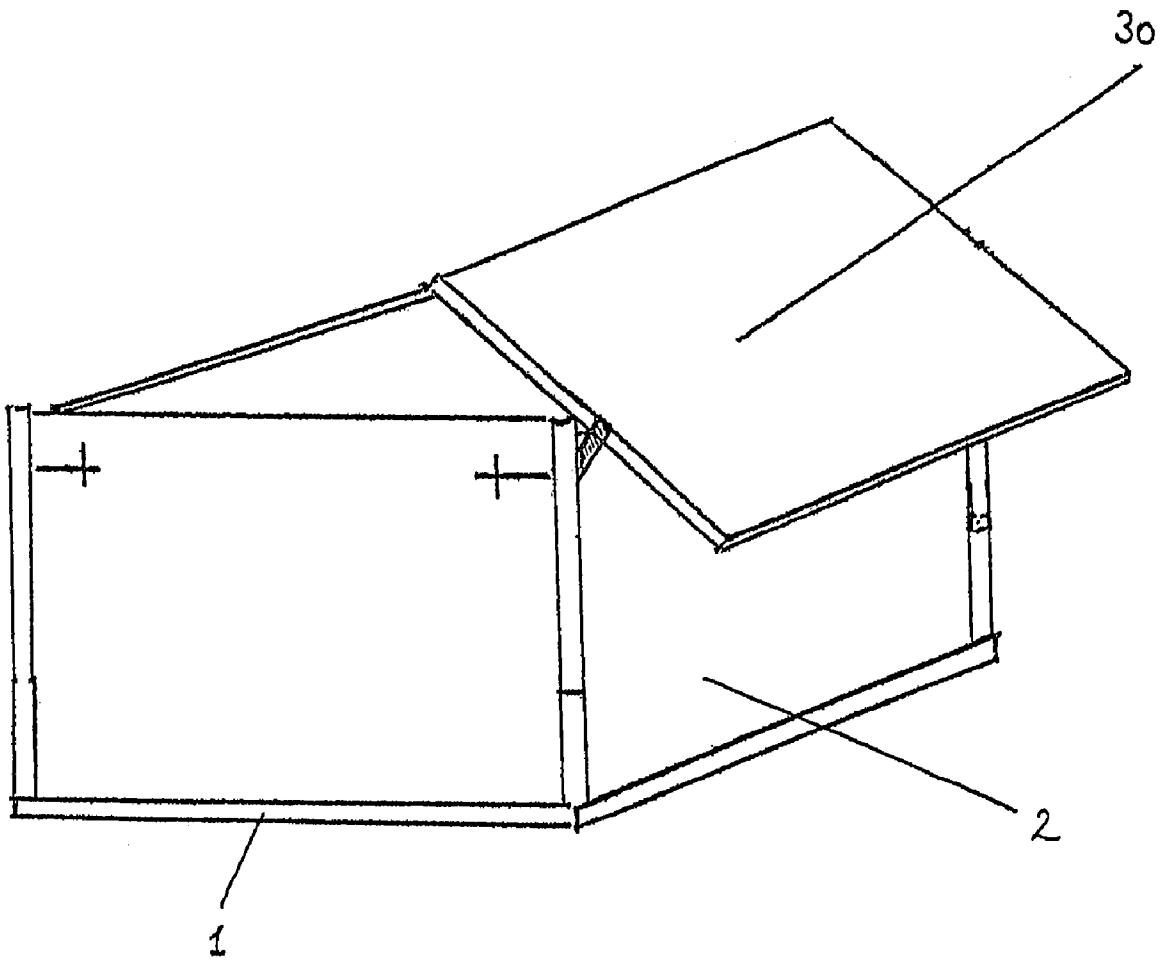

When all four side panels 2 have been moved from the folded to the unfolded position the upper edge 33 of the cover panel 30 is moved from a position substantially parallel to the major face of the side panel onto which it is mounted to an angled position by rotation of the arm 24 about the pin 26 as described above as shown in FIG. 15. The cover panel 30 is then moved upwards and away from the side panel 2 as shown in FIG. 16 by rotation about the pin 24 and sliding of the pin 24 along the slot 31 in the edge 32 of the cover panel 30 until it is resting on the upper edges of a front side panel 35 and a rear side panel 36 and substantially parallel to the container base panel 1 as shown in FIG. 17.

The container is unfolded to a collapsed condition by reversing the steps described above.

The person of ordinary skill in the art will appreciate that many modifications to the described embodiment are possible without departing from the spirit and scope of the invention defined in the appended claims. For instance wheels can be adapted to the base panel; the side support tubes may have any suitable transverse cross section; although the panels are preferably formed from metal, they could be formed of plastics or any other suitable material; the container can be suited for different uses and be of different sizes.

What I claim is:

1. A folding container comprising a base, side support means upstanding from the corners of said base, side panels located between said side support means and arranged to bound a storage space, and tot means arranged to pivotally mount the side panels onto said side support means, wherein the pivot means for each side panel is disposed in a different horizontal plane to that of any other panel, such that when the container is in a folded state the side panels lie stacked substantially parallel to the base, and when in an unfolded state the side panels are substantially orthogonal to the base;

wherein said pivot means of each side panel comprises a male means cooperating with a slot in an edge of the side panel which is adjacent to the side support means when the container is unfolded;

wherein said slot is terminated; and wherein said male means is arranged to be a free sliding fit along the length of a mating skit in each of the panel edges.

2. The folding container according to claim 1 wherein the side support means include a two part columnar member comprising a first member adjacent said base and a second member remote from said base, said second member being pivotally secured to said first member at a position such that when the container is in the folded state the second member can be folded onto a surface of an upper one of the stacked side panels.

3. A folding container according to claim 1 wherein each side panel is pivotally mounted onto each of two adjacent side support means.

4. A folding container according to claim 3 wherein each side panel substantially occupies a space between adjacent support means onto which each said side panel is mounted.

5. A folding container according to claim 1 wherein said male means comprises a pair of circularly cross sectioned pins located on adjacent side support means, wherein each pair of pins is arranged to mount side panels each at a different distance from the base.

6. A folding container according to claim 5 wherein a first pair of pins associated with a first sidepanel is located at a distance T-S/2 from the base panel, where T is S+R, S is the thickness of a side panel, and R is the distance between adjacent panels, a second pair of pins associated with a second side panel is located at a second distance, which is 2T-S/2 from the base panel, a third pair of pins associated with a third side panel is located at a third distance, which is 3T-S/2 from the base panel, and a fourth pair of pins associated with a fourth side panel is located at a fourth distance, which is 4T-S/2 from the base panel.

7. A folding container according to claim 1 wherein securing means are provided on the side panels to secure each individual side panel in the unfolded state in at least one of during and on completion of assembly.

8. A folding container according to claim 1 further comprising a cover panel pivotally mounted onto one of the side panels.

9. A folding container according to claim 1 wherein the side panels are formed from one of metal or plastic sheet material.

10. A folding container according to claim 1 wherein the base, side panels and support means form an integral unit.

* * * * *